US007802498B2

(12) United States Patent
Hu

(10) Patent No.: US 7,802,498 B2
(45) Date of Patent: Sep. 28, 2010

(54) RATCHET WRENCH WITH THREE OPERATIVE POSITIONS

(76) Inventor: Bobby Hu, No. 22, Lane 52, Sec. 3, Hui-Lai Road, Hsi-Tun Dist., Taichung (TW)

( * ) Notice: Subject to any disclaimer, the term of this patent is extended or adjusted under 35 U.S.C. 154(b) by 0 days.

(21) Appl. No.: 12/368,340

(22) Filed: Feb. 10, 2009

(65) Prior Publication Data

US 2010/0018357 A1 Jan. 28, 2010

(30) Foreign Application Priority Data

Jul. 24, 2008 (TW) ..... 97128138 A

(51) Int. Cl.
*B25B 13/46* (2006.01)

(52) U.S. Cl. ..... 81/63.1

(58) Field of Classification Search ..... 81/63.1, 81/62

See application file for complete search history.

(56) References Cited

U.S. PATENT DOCUMENTS

| | | | | |
|---|---|---|---|---|
| 3,867,855 | A * | 2/1975 | Siebert | 81/63.1 |
| 4,445,404 | A | 5/1984 | Parker | 81/62 |
| 4,491,043 | A | 1/1985 | Dempsey et al. | 81/58 |
| 4,529,071 | A * | 7/1985 | Gagnon et al. | 192/43.1 |
| 4,589,307 | A | 5/1986 | Parker | 81/62 |
| 6,076,433 | A | 6/2000 | Lynch | 81/63 |
| 6,125,722 | A | 10/2000 | Hopper et al. | 81/63 |
| 6,260,447 | B1 * | 7/2001 | Hutt | 81/63 |
| 6,857,339 | B2 * | 2/2005 | Chen | 81/63.1 |
| 6,971,285 | B2 * | 12/2005 | Chen | 81/63.1 |
| 6,981,434 | B2 * | 1/2006 | Chen | 81/63.1 |
| 7,055,411 | B2 * | 6/2006 | Huang | 81/63.1 |
| 7,080,579 | B2 * | 7/2006 | Chen | 81/63.1 |
| 7,082,859 | B2 * | 8/2006 | Huang | 81/62 |
| 7,111,527 | B1 | 9/2006 | Lee | 81/63.1 |
| 7,124,664 | B1 * | 10/2006 | Lee | 81/63.1 |

(Continued)

FOREIGN PATENT DOCUMENTS

EP 1808270 A1 * 7/2007

(Continued)

*Primary Examiner*—David B Thomas
(74) *Attorney, Agent, or Firm*—Alan Kamrath; Kamrath & Associates PA

(57) ABSTRACT

A ratchet wrench includes a body (10) having a driving portion (11) rotatably receiving a drive member (20; 20'; 20") and a handle (12) interconnected to the driving portion (11). Two pawls (30) are slideably received in a compartment (14) of the body (10). A control member (40) is slideably mounted on a recessed portion (15) formed on a side (18) of the body (10) and movable between first, second, and third operative positions to change the driving direction of the ratchet wrench. When the control member (40) is in the second operative position, the pawls (30) are engaged with the drive member (20; 20'; 20"), allowing the handle (12) and the drive member (20; 20'; 20") to rotate in either of two directions driving a fastener, and not allowing free rotation of the handle (12) relative to the drive member (20; 20'; 20") in either of the two directions without driving the fastener. The control member (40) includes a control section (42) slideably extending through a slot (151) in the recessed portion (15) into the compartment (14) to disengage one of the pawls (30) from the drive member (20; 20'; 20") when the control member (40) is in the first or third operative position.

7 Claims, 9 Drawing Sheets

U.S. PATENT DOCUMENTS

| | | | | |
|---|---|---|---|---|
| 7,263,918 | B1 * | 9/2007 | Chen | 81/63.1 |
| 7,299,720 | B1 * | 11/2007 | Schultz et al. | 81/63.1 |
| 7,313,987 | B1 * | 1/2008 | Chen | 81/63.1 |
| 2008/0229887 | A1 * | 9/2008 | Thompson et al. | 81/62 |
| 2008/0229889 | A1 * | 9/2008 | Hopper et al. | 81/63.1 |
| 2008/0245194 | A1 * | 10/2008 | Ross et al. | 81/63.1 |
| 2009/0007731 | A1 * | 1/2009 | Chen | 81/62 |

FOREIGN PATENT DOCUMENTS

| | | |
|---|---|---|
| TW | 235541 | 12/1994 |
| TW | 373543 | 11/1999 |
| TW | 399509 | 7/2000 |
| TW | 524174 | 3/2003 |
| TW | 589241 | 6/2004 |

* cited by examiner

RATCHET WRENCH WITH THREE OPERATIVE POSITIONS

BACKGROUND OF THE INVENTION

1. Field of the Invention

The present invention relates to a ratchet wrench and, more particularly, to a ratchet wrench that includes three operative positions.

2. The Prior Arts

Taiwan Patent Publication No. 524174 entitled "IMPROVED DIRECTION CONTROL STRUCTURE FOR RATCHET WRENCH" discloses a ratchet wrench including a body with a head having a compartment, a direction control groove, and a pawl groove intermediate and in communication with the compartment and the direction control groove. A gear wheel is rotatably received in the compartment, and a pawl is slideably received in the pawl groove. The pawl includes two pressing portions on a rear face thereof. The direction control groove includes a wall having two positioning recesses. A switch is slideably received in the direction control groove and movable between two operative positions. The switch includes a positioning slot and a receptacle. A T-shaped member includes a positioning section received in the positioning slot and a head section received in the pawl groove and located above the pawl. A biasing device is received in the receptacle and includes a ball, a pin, and a spring attached between the ball and the pin. The ball is selectively received in one of the positioning recesses, and the pin selectively presses against one of the pressing portions of the pawl corresponding to one of the operative positions of the switch in the direction control groove, so that the ratchet wrench can drive fasteners such as bolts, nuts, etc. in one of two operative directions (clockwise and counterclockwise) while allowing free rotation in a reverse direction. However, the ratchet wrench can not be utilized as a conventional wrench of the type capable of driving fasteners in either direction and not allowing free rotation in the reverse direction, which may be required in some cases. As an example, when it is desired to proceed with slight tightness adjustment of a fastener by rotating the fastener in the tightening direction and/or loosening direction before the desired tightness is obtained, a user has to frequently move the switch between the two operative positions to change the driving direction of the ratchet wrench, which is time-consuming and laborsome.

Thus, a need exists for a ratchet wrench that allows easy operation in the slight tightness adjustment.

SUMMARY OF THE INVENTION

The present invention solves this need and other problems in the field of easy operation of wrenches by providing, in a preferred form, a ratchet wrench including a body having a driving portion and a handle interconnected to the driving portion. The driving portion includes first and second sides spaced in a thickness direction. The driving portion further includes a first compartment extending in the thickness direction. The driving portion further includes a second compartment in communication with the first compartment and intermediate the first and second sides. The driving portion further includes a recessed portion formed on the first side. The recessed portion has a surface intermediate and spaced from the first and second sides along the thickness direction. The recessed portion includes a slot in communication with the second compartment. A drive member is rotatably received in the first compartment. The drive member includes a plurality of teeth in an outer periphery thereof. First and second pawls are slideably received in the second compartment. Each of the first and second pawls includes an inner face facing the teeth of the drive member. The inner face of each of the first and second pawls includes a plurality of teeth releasably engaged with the teeth of the drive member. An elastic element is mounted between the first and second pawls to bias the first and second pawls away from each other to engage the teeth of the first and second pawls with the teeth of the drive member. Each of the first and second pawls further includes a top face transverse to the inner face. The first pawl includes a first coupling portion on the top face thereof, and the second pawl includes a second coupling portion on the top face thereof. A control member is slideably mounted on the surface of the recessed portion between first, second, and third operative positions. The second operative position is intermediate the first and third operative positions. The control member includes a control section slideably extending through the slot into the second compartment.

When the control member is in the first operative position, the teeth of the second pawl are engaged with the teeth of the drive member, and the control section of the control member is engaged with the first coupling portion of the first pawl to disengage the teeth of the first pawl from the teeth of the drive member, allowing the handle and the drive member to rotate in a first direction driving a fastener in the first direction, and allowing the handle to rotate freely relative to the drive member in a second direction reverse to the first direction without driving the fastener.

When the control member is in the third operative position, the teeth of the first pawl are engaged with the teeth of the drive member, and the control section of the control member is engaged with the second coupling section of the second pawl to disengage the teeth of the second pawl from the teeth of the drive member, allowing the handle to rotate in the second direction driving the fastener in the second direction, and allowing the handle to rotate freely relative to the drive member in the first direction without driving the fastener.

When the control member is in the second operative position, the teeth of each of the first and second pawls are engaged with the teeth of the drive member, allowing the handle and the drive member to rotate in either of the first and second directions driving the fastener, and not allowing free rotation of the handle relative to the drive member in either of the first and second directions without driving the fastener.

In the most preferred form, the control member includes first and second faces spaced in the thickness direction. The control member further includes a positioning slot extending from the first face through the second face. The positioning slot includes a wall having first, second, and third positioning grooves. A positioning member is received in the positioning slot. The surface of the recessed portion includes a fixing hole extending in the thickness direction and aligned with the positioning slot. A pin is extended through the positioning member and has an end fixed in the fixing hole. The positioning member and the pin are not moved when the control member is moved between the first, second, and third operative positions. The positioning member is selectively engaged with one of the first, second, and third positioning grooves to retain the control member in one of the first, second, and third operative positions.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
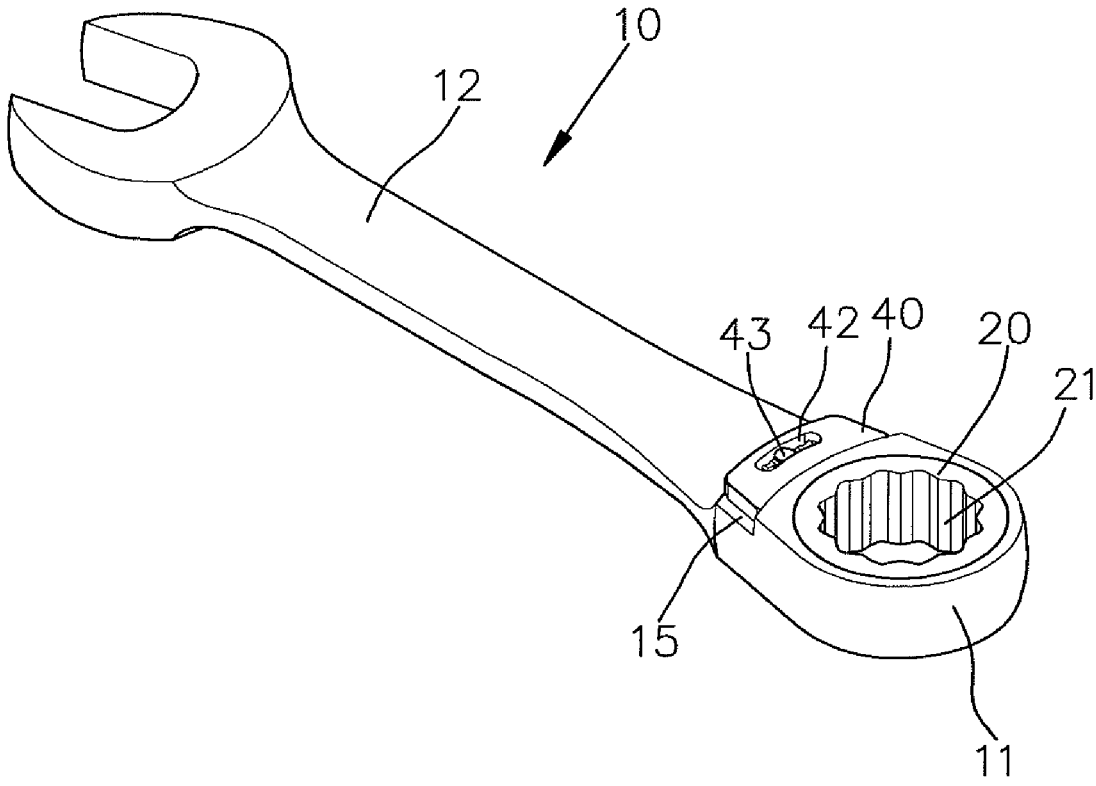
FIG. 1 shows a perspective view of a ratchet wrench with three operative positions according to the preferred teachings of the present invention.
Figure 2:
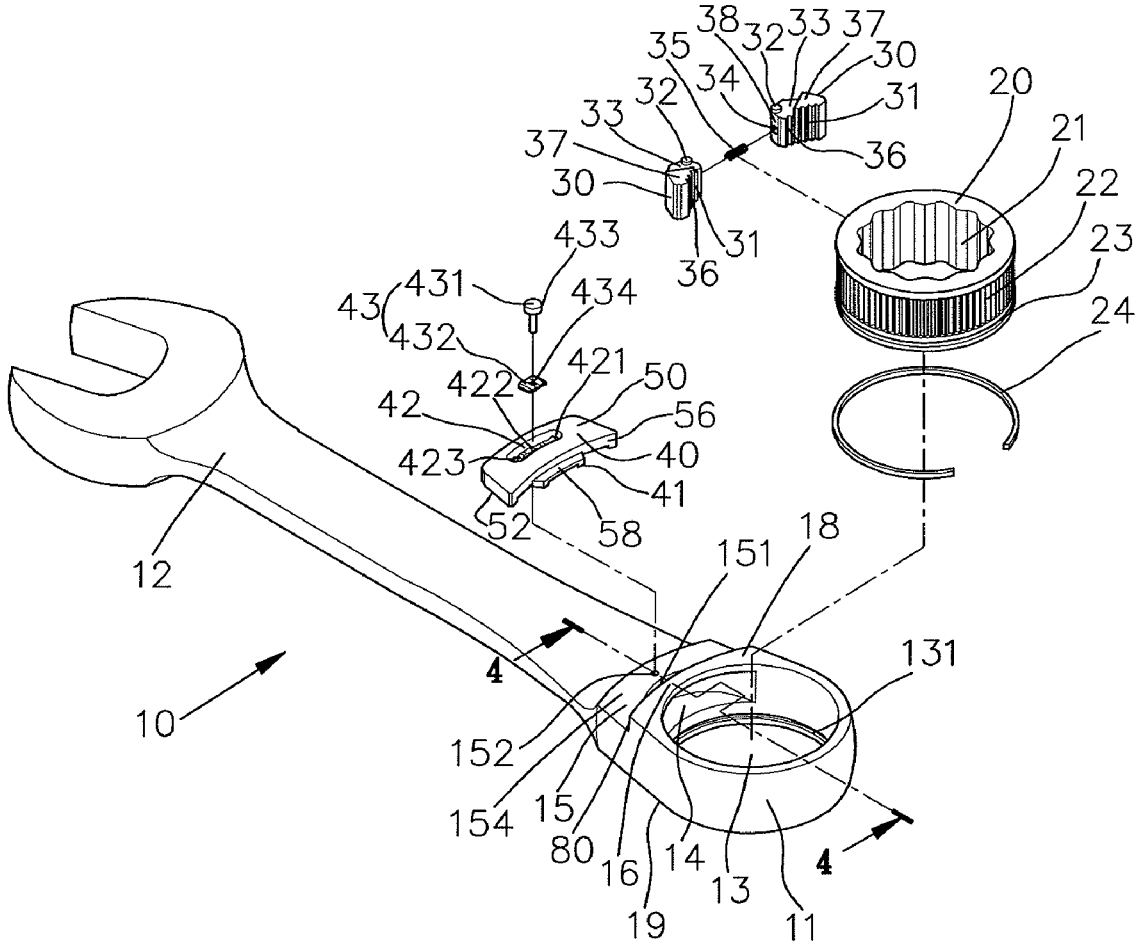
FIG. 2 shows an exploded, perspective view of the ratchet wrench of FIG. 1.
Figure 3:
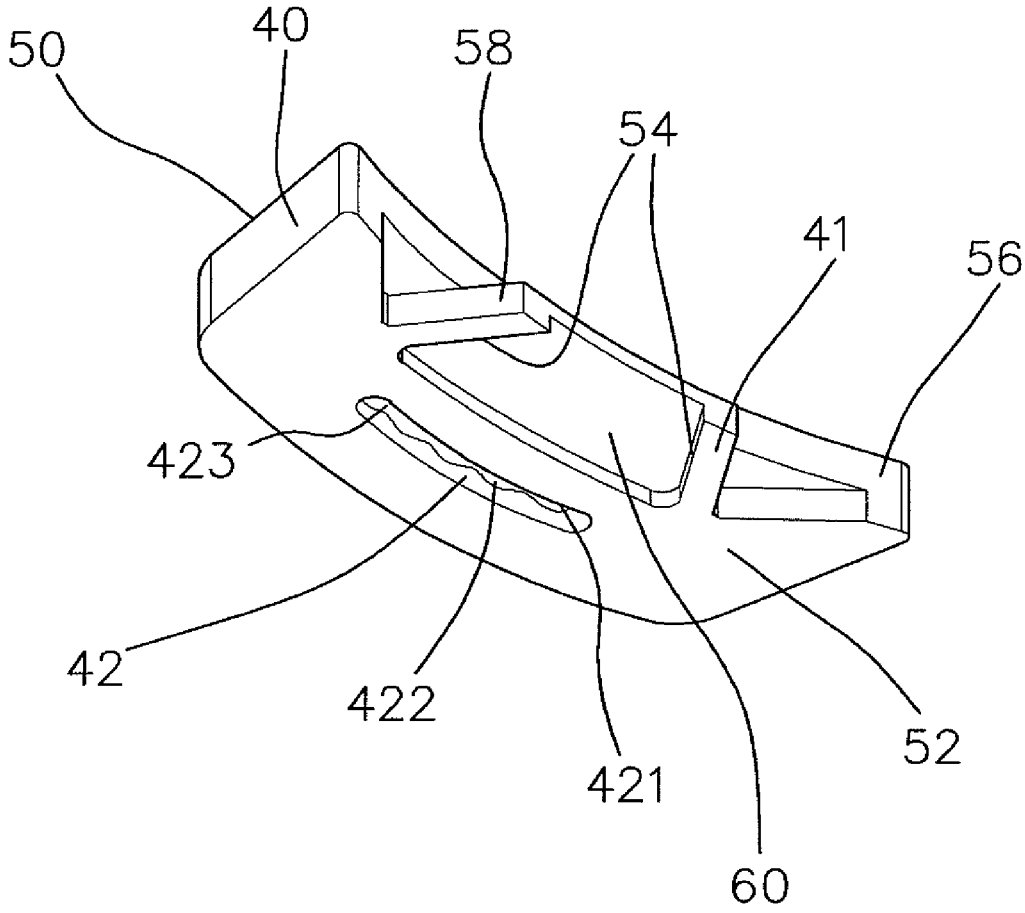
FIG. 3 shows a bottom, perspective view of a control member of the ratchet wrench of FIG. 1.
Figure 4:
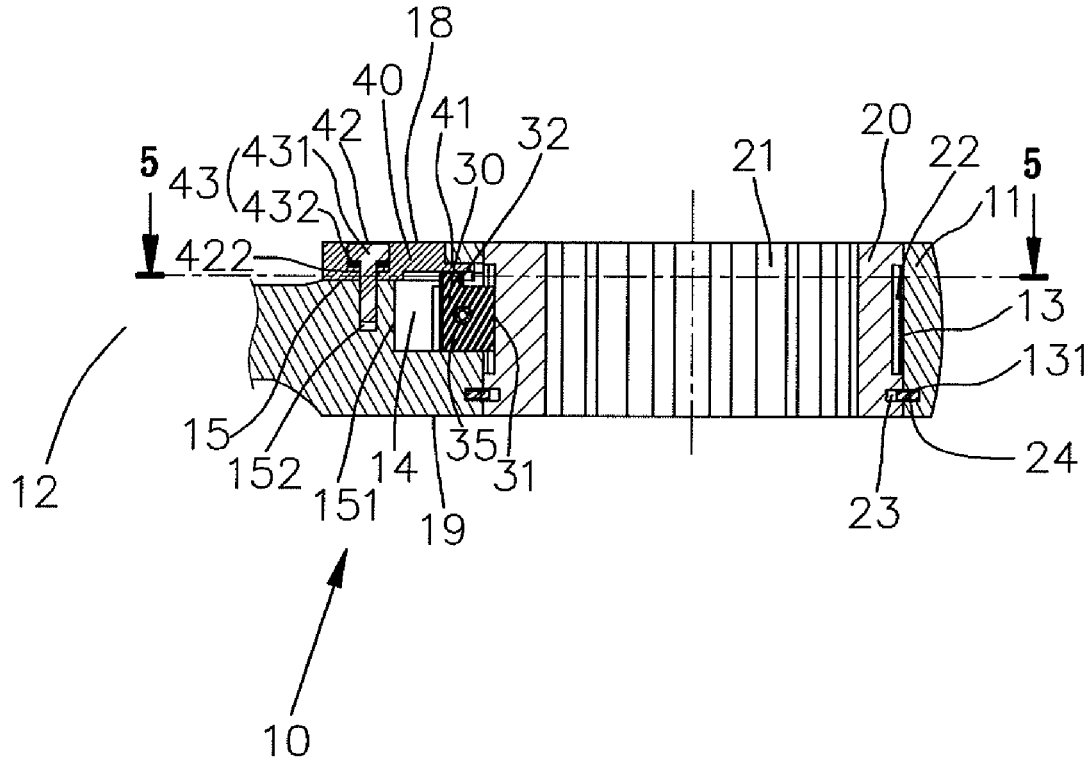
FIG. 4 shows a partial, cross sectional view of the ratchet wrench of FIG. 1 according to section line 4-4 of FIG. 2.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "annular", "clockwise", "counterclockwise", "length", "width", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

A ratchet wrench according to the preferred teachings of the present invention is shown in the drawings and generally includes a body 10 having a driving portion 11 and a handle 12 interconnected to driving portion 11. Driving portion 11 includes opposite first and second sides 18 and 19 spaced in a thickness direction and a first compartment 13 in the most preferred form shown as a through-hole extending from first side 18 through second side 19. An annular groove 131 is defined in an end of a peripheral wall of first compartment 13. According to the most preferred form shown, a second compartment 14 is defined between first and second sides 18 and 19 and in communication with first compartment 13. Driving portion 11 further includes a recessed portion 15 formed on first side 18 and having a surface 154 intermediate and spaced from first and second sides 18 and 19 in the thickness direction. Surface 154 includes a fixing hole 152 extending in the thickness direction. Furthermore, recessed portion 15 is spaced from first compartment 13 in a length direction perpendicular to the thickness direction by a bridge 16 that is a part of first side 18 of driving portion 11. Further, bridge 16 forms a sidewall delimiting second compartment 14. An arcuate interconnecting wall 80 extends in the thickness direction and is interconnected between bridge 16 and surface 154 of recessed portion 15. A slot 151 extends through arcuate interconnecting wall 80 and is in communication with second compartment 14.

According to the preferred form shown, a drive member 20 is rotatably received in first compartment 13. Drive member 20 includes a driving section 21 in a central portion thereof for directly or indirectly engaging with a fastener to be loosened or tightened. According to the most preferred form shown, driving section 21 includes a through-hole having a polygonal inner periphery for engaging and driving a fastener. Other forms of driving section 21 would be within the skill of the art. Drive member 20 further includes a plurality of teeth 22 in an outer periphery thereof. An annular groove 23 is formed in an end of the outer periphery of drive member 20. A retainer ring 24 in the most preferred form shown as a C-clip is partially received in annular groove 23 of drive member 20 and partially received in annular groove 131 of body 10, allowing rotation of drive member 20 relative to body 10 while retaining drive member 20 in first compartment 13.

According to the preferred form shown, first and second pawls 30 are slideably received in two ends of second compartment 14. Each of first and second pawls 30 includes an inner face 36 facing teeth 22 of drive member 20. Inner face 36 of each of first and second pawls 30 includes a plurality of teeth 31 releasably engaged with teeth 22 of drive member 20. Each of first and second pawls 30 further includes a top face 37 transverse to inner face 36. Top face 37 includes a recessed portion 33. According to the most preferred form shown, a coupling portion 32 in the preferred form shown as a peg is formed on an inner end of recessed portion 33 of top face 37 of each of first and second pawls 30. Each of first and second pawls 30 further includes an end face 38 transverse to top face 37 and to inner face 36. End faces 38 face each other, and each has a receptacle 34. An elastic element 35 in the most preferred form shown as a spring is attached between first and second pawls 30 and includes two ends received in receptacles 34. Elastic element 35 biases first and second pawls 30 away from each other to engage teeth 31 of first and second pawls 30 with teeth 22 of drive member 20.

According to the preferred form shown, a control member 40 is slideably mounted on surface 154 of recessed portion 15 between first, second, and third operative positions. Control member 40 includes first and second faces 50 and 52 spaced in the thickness direction. Control member 40 further includes an arcuate inner wall 56 extending between first and second faces 50 and 52 in the thickness direction and facing first compartment 13. After assembly, first face 50 of control member 40 is flush with first side 18 of driving portion 11, and arcuate inner wall 56 abuts arcuate interconnecting wall 80. Control member 40 further includes a control section 41 in the most preferred form shown as a projection 58 extending beyond arcuate inner wall 56 and slideably extending through slot 151. Projection 58 includes a groove 60 having first and second lateral walls 54 substantially spaced in a width direction perpendicular to the length and thickness directions. Control member 40 further includes a positioning slot 42 extending from first face 50 through second face 52. Positioning slot 42 includes a wall having first, second, and third positioning grooves 421, 422, and 423 corresponding to the first, second, and third operative positions.

In the preferred form shown, a positioning device 43 is provided to position control member 40 in one of the first, second, and third operative positions. According to the most preferred form shown, positioning device 43 includes a positioning member 432 received in positioning slot 42 and having a through-hole 434. A pin 431 extends through through-hole 434 of positioning member 432 and has an end fixed in fixing hole 152. Pin 431 further includes an enlarged head 433 on the other end thereof and received in positioning slot 42. Positioning member 432 and pin 431 are not moved when control member 40 is moved between the first, second, and third operative positions. However, positioning member 432 is selectively engaged with one of first, second, and third positioning grooves 421 422, and 423 to retain control member 40 in one of the first, second, and third operative positions. Other forms of positioning device 43 would be within the skill of the art. Note that arcuate inner wall 56 of control member 40 slides along arcuate interconnecting wall 80 when control member 40 is moved between the first, second, and third operative positions.

Figure 5:
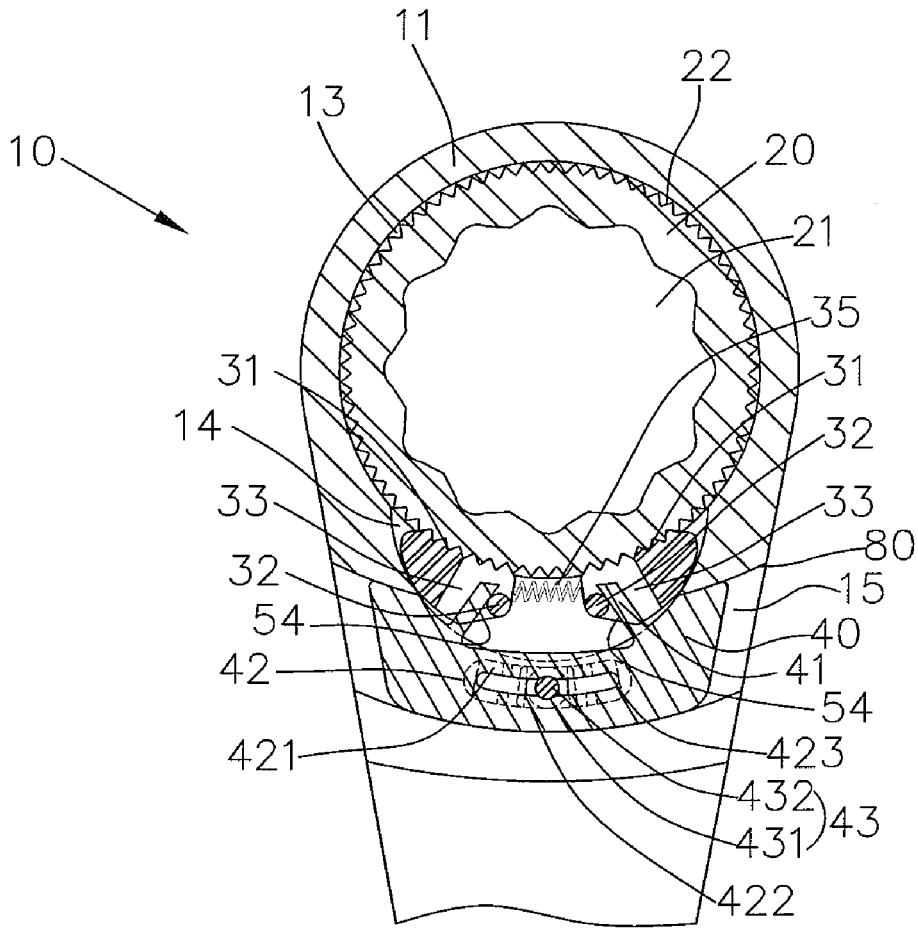
FIG. 5 shows a partial, cross sectional view of the ratchet wrench of FIG. 1 according to section line 5-5 of FIG. 4 with the control member in a second operative position.

Now that the basic construction of the ratchet wrench of the preferred teachings of the present invention has been explained, the operation and some of the advantages of the ratchet wrench can be set forth and appreciated. In particular, for the sake of explanation, it will be assumed that control member 40 is initially in the second operative position (FIG. 5) intermediate the first and third operative positions. Positioning member 432 is received in second positioning groove 422 of control member 40. The coupling portions 32 of first and second pawls 30 are located between and not engaged with first and second lateral walls 54. Furthermore, teeth 31 of each of first and second pawls 30 are engaged with teeth 22 of drive member 20, allowing handle 12 and drive member 20 to rotate in either clockwise or counterclockwise directions to drive a fastener in the same direction. Free rotation of handle 12 relative to drive member 20 in either direction without driving the fastener is not allowed. Thus, the ratchet wrench according to the preferred teachings of the present invention can be utilized to perform slight tightness adjustment of the fastener when control member 40 is in the second operative position.

Figure 6:
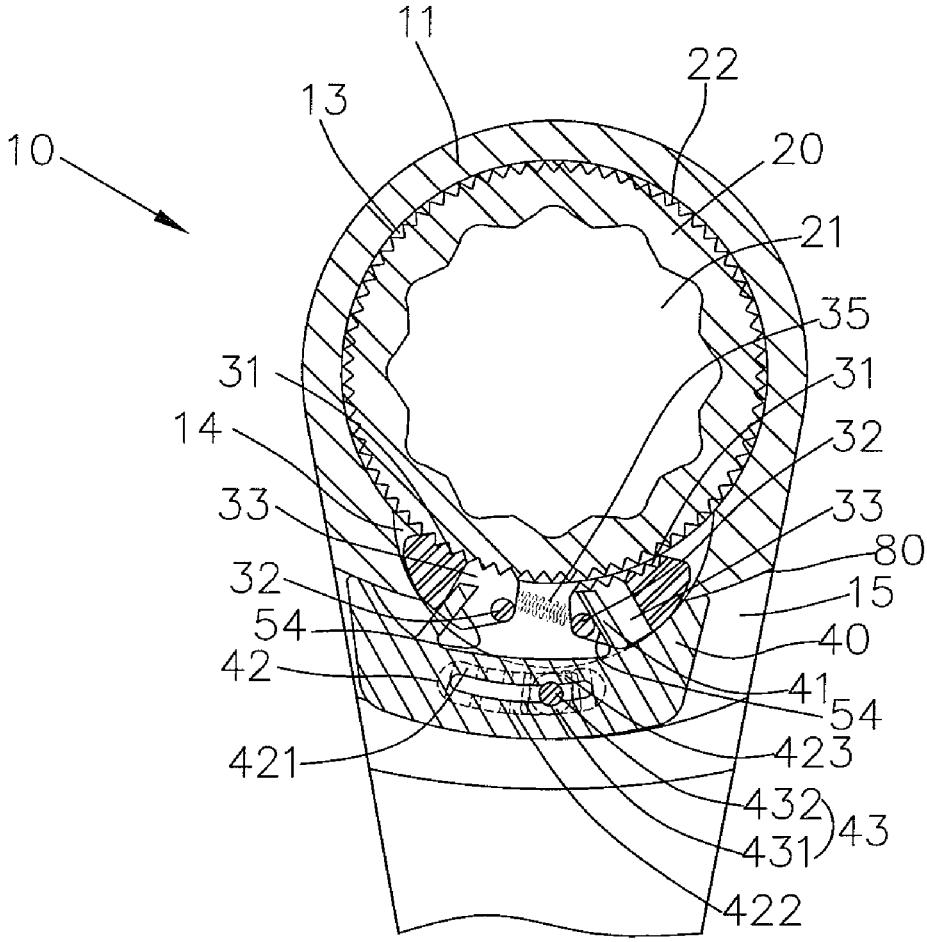
FIG. 6 shows a partial, cross sectional view similar to FIG. 5 with the control member in a third operative position.

When the control member 40 is moved from the second operative position to the third operative position (FIG. 6), second lateral wall 54 of control section 41 of control member 40 engages with and moves second coupling portion 32 of second pawl 30. Thus, second pawl 30 is moved away from drive member 20. As a result, teeth 31 of second pawl 30 are disengaged from teeth 22 of drive member 20. Teeth 31 of first pawl 30 are still engaged with teeth 22 of drive member 20, and first lateral wall 54 of control section 41 moves away from first coupling portion 32 of first pawl 30 in a direction without actuating first coupling portion 32 of first pawl 30. Positioning member 432 is received in third positioning groove 423 of control member 40. In this state, handle 12 and drive member 20 can rotate in the counterclockwise direction to drive the fastener in the counterclockwise direction. Furthermore, handle 12 can rotate freely relative to drive member 20 in the clockwise direction without driving the fastener.

Figure 7:
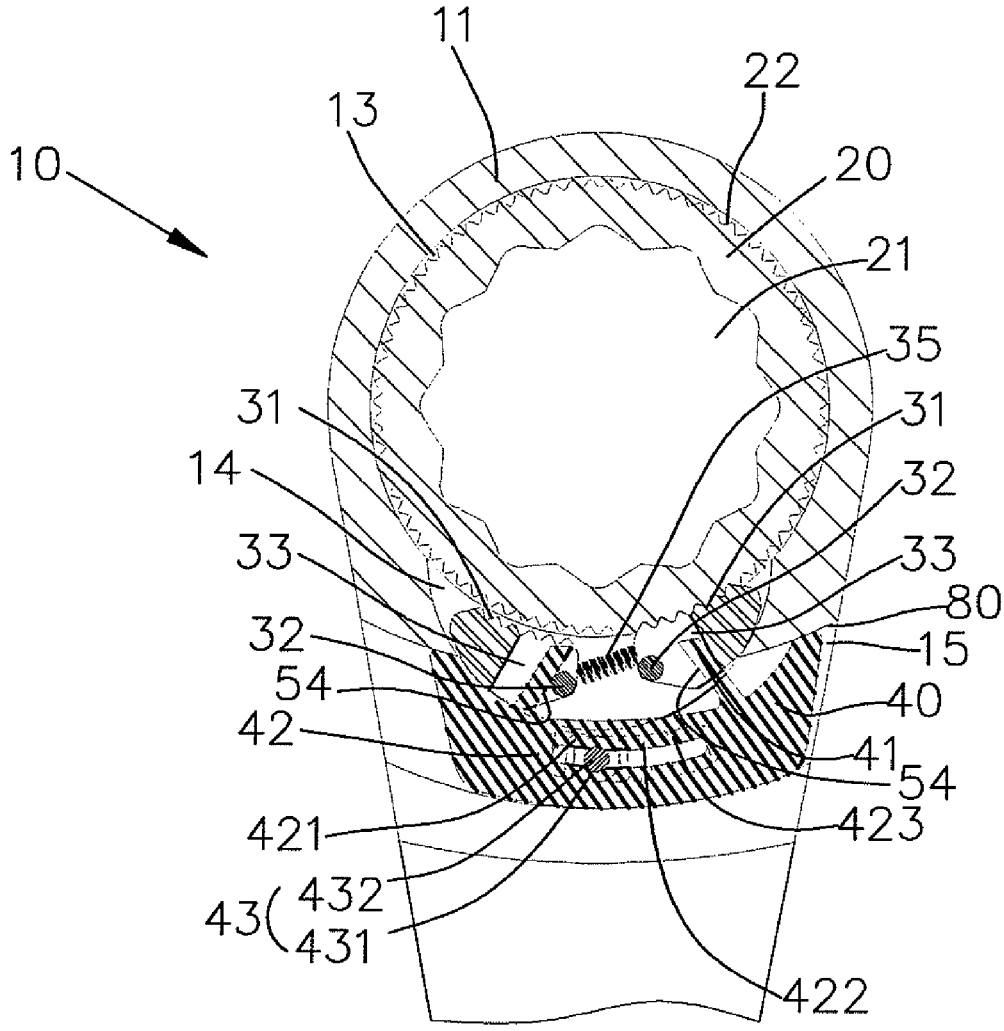
FIG. 7 shows a partial, cross sectional view similar to FIG. 5 with the control member in a first operative position.

When the control member 40 is pivoted from the second operative position to the first operative position (FIG. 7), first lateral wall 54 of control section 41 of control member 40 engages with and moves first coupling portion 32 of first pawl 30. Thus, first pawl 30 is moved away from drive member 20. As a result, teeth 31 of first pawl 30 are disengaged from teeth 22 of drive member 20. Teeth 31 of second pawl 30 are still engaged with teeth 22 of drive member 20, and second lateral wall 54 of control section 41 moves away from second coupling portion 32 of second pawl 30 in a direction without actuating second coupling portion 32 of second pawl 30. Positioning member 432 is received in first positioning groove 421 of control member 40. In this state, handle 12 and drive member 20 can rotate in the clockwise direction to drive the fastener in the clockwise direction. Furthermore, handle 12 can rotate freely relative to drive member 20 in the counterclockwise direction without driving the fastener.

Figure 8:
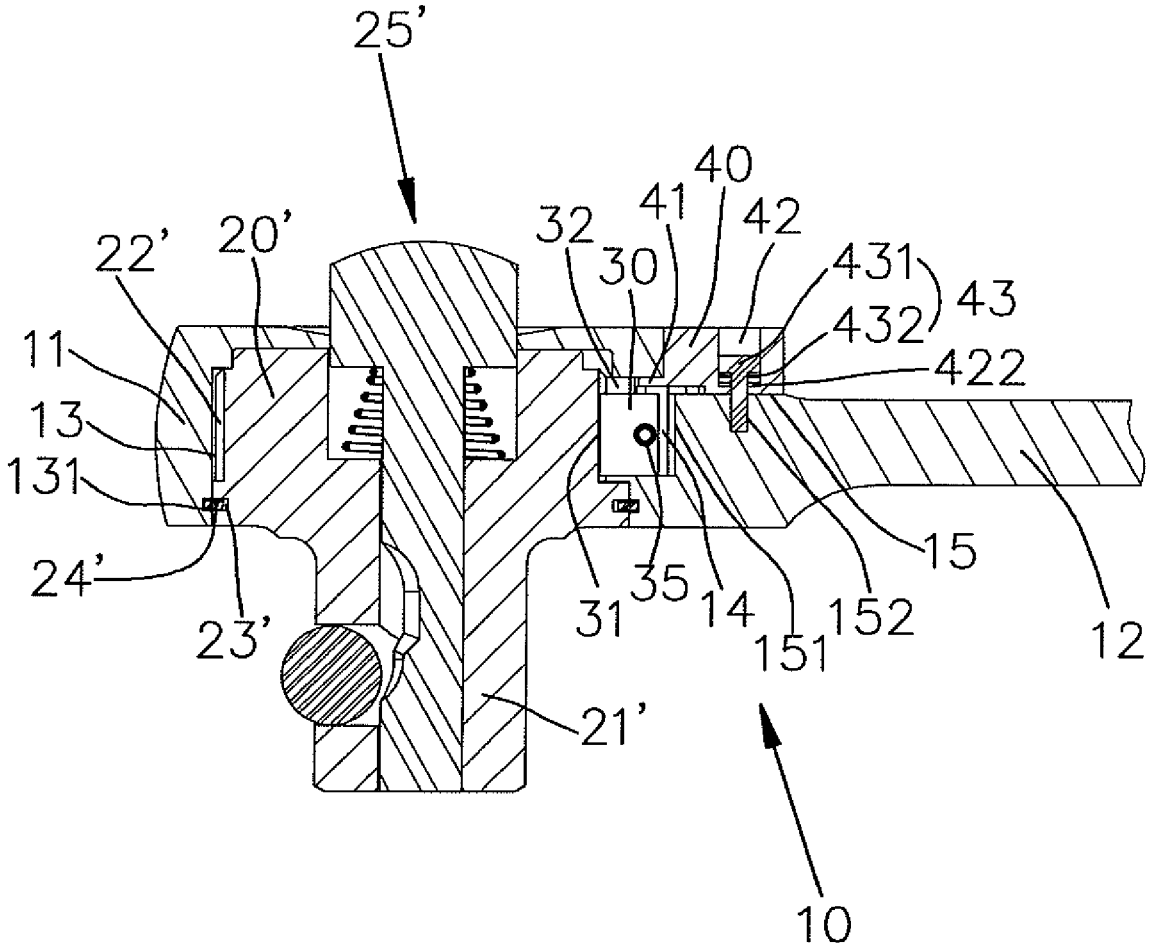
FIG. 8 shows a partial, cross sectional view of a ratchet wrench of a modified embodiment according to the preferred teachings of the present invention.
Figure 9:
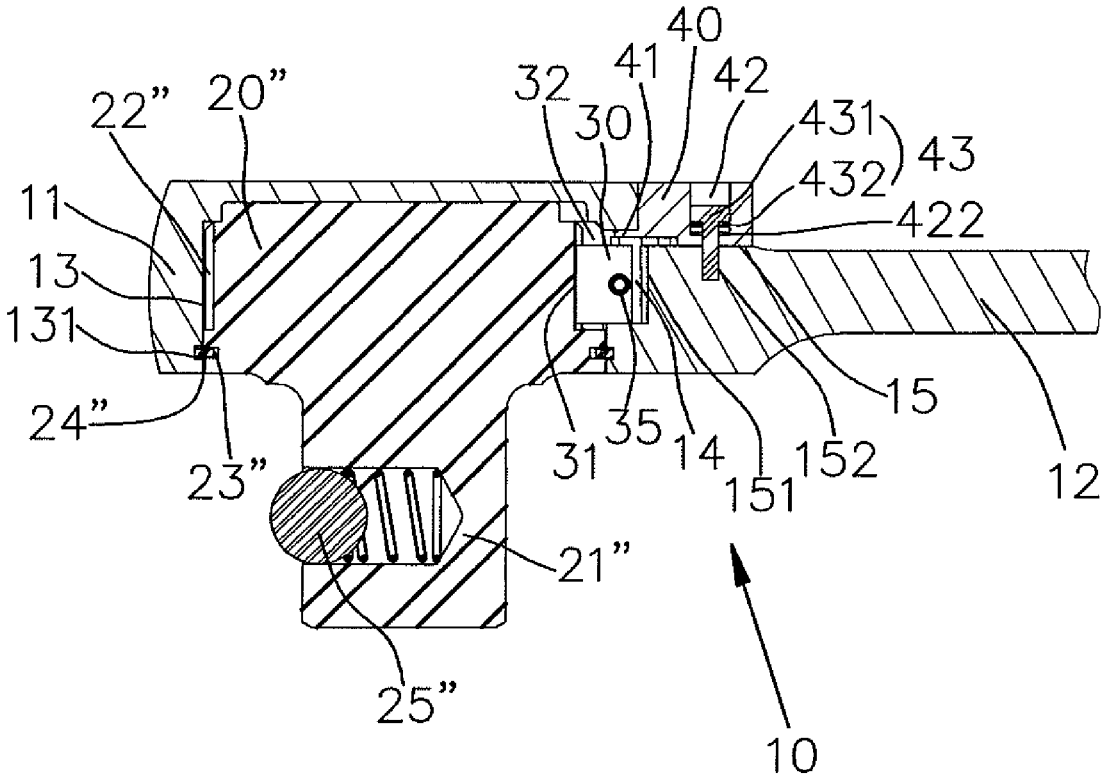
FIG. 9 shows a partial, cross sectional view of a ratchet wrench of another modified embodiment according to the preferred teachings of the present invention.

Now that the basic teachings of the present invention have been explained, many extensions and variations will be obvious to one having ordinary skill in the art. Drive member 20 can be of other forms. In a modified example shown in FIG. 8, drive member 20' also includes a plurality of teeth 22' and an annular groove 23' in an outer periphery thereof. A retainer ring 24' in the form of a C-clip is mounted in annular groove 23' of drive member 20' and annular groove 131 of body 10 to allow rotation of drive member 20' in first compartment 13. Furthermore, drive member 20' includes a drive section 21' outside of driving portion 11 of body 10. Drive section 21' is in the form of a drive column having square cross sections. Drive section 21' includes a spring-biased coupler 25' for releasable coupling with a socket. In another modified example shown in FIG. 9, drive member 20" also includes a plurality of teeth 22" and an annular groove 23" in an outer periphery thereof. A retainer ring 24" in the form of a C-clip is mounted in annular groove 23" of drive member 20" and annular groove 131 of body 10 to allow rotation of drive member 20" in first compartment 13. Furthermore, drive member 20" includes a drive section 21" outside of driving portion 11 of body 10. Drive section 21" is in the form of a drive column having square cross sections. Drive section 21" includes a spring-biased quick-release coupler 25" allowing releasable coupling with a socket. Other forms of drive member 20, 20', 20" would be within the skill of the art. Furthermore, driving portion 11 of body 10 can be of other forms without adversely affecting the function of rotatably receiving drive member 20, 20', 20", examples of which are shown in FIGS. 8 and 9. Recessed portion 33 of top face 37 of each of first and second pawls 30 can be omitted if desired, so that first and second coupling portions 32 in the form of pegs are directly formed on top faces 37. Further, the pegs can have other forms including but not limited to square, rectangular, and irregular shapes. Control section 41 of control member 40 can have other forms. As an example, control section 41 can be in the form of two tabs extending from arcuate inner wall 56, with inner faces of the tabs forming first and second lateral walls 54 for coupling with first and second coupling portions 32. Positioning member 432 can be in the form of a protrusion integrally formed with pin 431 as a single continuous monolithic piece.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A ratchet wrench comprising, in combination:

a body including a driving portion and a handle interconnected to the driving portion, with the driving portion including first and second sides spaced in a thickness direction, with the driving portion further including a first compartment extending in the thickness direction, with the driving portion further including a second compartment in communication with the first compartment and intermediate the first and second sides, with the driving portion further including a recessed portion formed on the first side, with the recessed portion having a surface intermediate and spaced from the first and second sides along the thickness direction and intermediate the first compartment and the handle, with the recessed portion including a slot located intermediate the surface of the recessed portion and the first side, with the slot being in communication with the second compartment;

a drive member rotatably received in the first compartment, with the drive member including a plurality of teeth in an outer periphery thereof;

first and second pawls slideably received in the second compartment, with each of the first and second pawls including an inner face facing the plurality of teeth of the drive member, with the inner face of each of the first and second pawls including a plurality of teeth releasably engaged with the plurality of teeth of the drive member, with an elastic element being mounted between the first and second pawls to bias the first and second pawls away from each other to engage the plurality of teeth of the first and second pawls with the plurality of teeth of the drive member, with each of the first and second pawls further including a top face transverse to the inner face, with the first pawl including a first coupling portion on the top face thereof, with the second pawl including a second coupling portion on the top face thereof; and a control member slideably mounted on the surface of the recessed portion between first, second, and third operative positions, with the second operative position intermediate the first and third operative positions, with the control member positioned over the surface of the recessed portion and including a control section slideably extending through the slot into the second compartment, wherein when the control member is in the first operative position, the plurality of teeth of the second pawl are engaged with the plurality of teeth of the drive member, the control section of the control member is engaged with the first coupling portion of the first pawl to disengage the plurality of teeth of the first pawl from the plurality of teeth of the drive member, allowing the handle and the drive member to rotate in a first direction driving a fastener in the first direction, and allowing the handle to rotate freely relative to the drive member in a second direction reverse to the first direction without driving the fastener, wherein when the control member is in the third operative position, the plurality of teeth of the first pawl are engaged with the plurality of teeth of the drive member, the control section of the control member is engaged with the second coupling section of the second pawl to disengage the plurality of teeth of the second pawl from the plurality of teeth of the drive member, allowing the handle and the drive member to rotate in the second direction driving the fastener in the second direction, and allowing the handle to rotate freely relative to the drive member in the first direction without driving the fastener, and wherein when the control member is in the second operative position, the plurality of teeth of each of the first and second pawls are engaged with the plurality of teeth of the drive member, allowing the handle and the drive member to rotate in either of the first and second directions driving the fastener, and not allowing free rotation of the handle relative to the drive member in either of the first and second directions without driving the fastener, with the control member including first and second faces spaced in the thickness direction, with the control member further including a positioning slot extending from the first face through the second face, with the positioning slot including a wall having first, second, and third positioning grooves, with the ratchet wrench further comprising, in combination: a positioning member received in the positioning slot and fixed relative to the surface of the recessed portion, with the positioning member being not moved when the control member is moved between the first, second, and third operative positions, and with the positioning member selectively engaged with one of the first, second, and third positioning grooves to retain the control member in one of the first, second, and third operative positions.

2. The ratchet wrench as claimed in claim 1, with the surface of the recessed portion including a fixing hole extending in the thickness direction and aligned with the positioning slot, with the ratchet wrench further comprising, in combination: a pin extending through the positioning member and having an end fixed in the fixing hole.

3. The ratchet wrench as claimed in claim 2, with the control member further including an arcuate inner wall extending between the first and second faces in the thickness direction and facing the first compartment, with the recessed portion spaced from the first compartment in a length direction perpendicular to the thickness direction by a bridge that is a part of the first side of the driving portion, with the bridge forming a sidewall delimiting the second compartment, with an arcuate interconnecting wall extending in the thickness direction and interconnected between the bridge and the surface of the recessed portion, with the slot extending through the arcuate interconnecting wall, with the arcuate inner wall abutting the arcuate interconnecting wall, and with the arcuate inner wall sliding along the arcuate interconnecting wall when the control member is moved between the first, second, and third operative positions.

4. The ratchet wrench as claimed in claim 3, with the first face of the control member flush with the first side of the driving portion, with the positioning slot having a width perpendicular to the thickness direction, with the fixing hole having a diameter smaller than the width of the positioning slot, with the positioning member including a through-hole through which the pin extends, with the pin further including an enlarged head on another end thereof, and with the enlarged head received in the positioning slot.

5. The ratchet wrench as claimed in claim 3, with the control section including first and second lateral walls substantially spaced in a width direction perpendicular to the thickness and length directions, wherein when the control member is in the second operative position, the first and second coupling portions are not engaged with the first and second lateral walls, wherein when the control member is in the first operative position, the first lateral wall of the control section is engaged with the first coupling portion to disengage the plurality of teeth of the first pawl from the plurality of teeth of the drive member, and wherein when the control member is in the third operative position, the second lateral wall of the control section is engaged with the second coupling portion to disengage the plurality of teeth of the second pawl from the plurality of teeth of the drive member.

6. The ratchet wrench as claimed in claim 5, with the control member including a projection extending beyond the arcuate inner wall and slideably extending through the slot, with the projection including a groove having the first and second lateral walls, with the groove spaced from the positioning slot and having decreasing widths between the first and second lateral walls toward the first compartment.

7. The ratchet wrench as claimed in claim 3, with the first coupling portion including a first peg formed on an inner end of the top face of the first pawl, with the second coupling portion including a second peg formed on an inner end of the top face of the second pawl, with each of the first and second pawls including an end face transverse to the top face and to the inner face, with the end faces facing each other and each having a receptacle, and with the elastic element including a spring having two ends received in the receptacles.

* * * * *